United States Patent [19]

Allen

[11] 4,009,577

[45] Mar. 1, 1977

[54] COOLING TOWER BLOWDOWN HEAT EXCHANGE SYSTEM

[76] Inventor: John L. Allen, 2253 West Ave., Ocean City, N.J. 08226

[22] Filed: Jan. 21, 1976

[21] Appl. No.: 651,125

[52] U.S. Cl. ..... 60/692; 165/2; 165/45; 165/66; 261/157

[51] Int. Cl.[2] ..... F02M 31/00

[58] Field of Search ..... 165/2, 45, 66; 60/690, 60/692; 261/152, 157

[56] References Cited

UNITED STATES PATENTS

| | | | |
|---|---|---|---|
| 3,536,610 | 10/1970 | Stork | 261/157 X |
| 3,788,385 | 1/1974 | Delahunty | 60/690 X |
| 3,878,273 | 4/1975 | Anderson | 261/157 X |
| 3,928,145 | 12/1975 | Othmer | 60/690 X |

*Primary Examiner*—C. J. Husar
*Assistant Examiner*—Sheldon Richter
*Attorney, Agent, or Firm*—Paul & Paul

[57] ABSTRACT

Thermal pollution from industrial manufacturing and electric generation plants is avoided by incorporating in the water-cooling system of such plants a heat exchanger to allow the heat load, which would otherwise be injected into the source of external water supply, to be exchanged through the cooling tower to the atmosphere. In a preferred embodiment, the system incorporates a counterflow heat exchanger so that the temperature of all water exhausted into the source of external water supply is within the few degrees of the temperature of the external water supply.

10 Claims, 2 Drawing Figures

COOLING TOWER BLOWDOWN HEAT EXCHANGE SYSTEM

BACKGROUND OF THE INVENTION

This invention relates to evaporative cooling towers used in conjunction with electric power generation plants.

Many industrial processes use surface water from rivers and lakes for cooling purposes. Usually the water is returned to the same source but at a temperature substantially higher, sometimes as much as 30° F higher, depending upon climatic conditions. Such a substantial change in water temperature may adversely affect the aquatic ecology and this effect is commonly referred to as "thermal pollution."

In the United States, the greatest single source of waste heat discharged into surface waters is electrical power generation. The amount of water withdrawn for this purpose alone in the United States is estimated to be about 40 trillion gallons annually. With an increasing demand for electrical power, there is rising concern about the thermal pollution resulting from such increased generation. The Federal Water Pollution Control Administration of the Department of the Interior has held extensive hearings and the potential ecological hazard to aquatic life caused by the dissipation of waste heat through natural water flow has been described in detail. See, for example, Thermal Pollution and Aquatic Life, *Scientific American*, March 1969, Volume 220, Number 3.

Various approaches have been suggested to decrease the thermal pollution problem. U.S. Pat. No. 3,760,868 discloses a system which incorporates a municipal domestic water distribution system as a heat sink to lessen the heat load injected into the external water supply. U.S. Pat. No. 3,851,495 discloses a system which incorporates an underground water storage and heat dissipation space formed by a nuclear explosion as a heat sink to lessen thermal pollution. Numerous other approaches have been proposed which involve decreasing the amount of heat injected into the external water supply by either utilizing alternative liquid heat sinks, or by transferring the heat load into the atmosphere.

Cooling towers of both the mechanical and natural draft type have been utilized for some time to exchange the heat load from water into the atmosphere. The water that is circulated through the cooling towers is continually changing because some water is lost to the atmosphere by evaporation and "drift," as described below. Also, it is necessary to continually withdraw a portion of water, termed blowdown water, to avoid a buildup of scale in the circulating water system. Makeup water is injected into the tower to make up the losses from the sources described above. In the past, the blowdown water has been exhausted directly into the external water supply. The temperature of this blowdown water in relation to the temperature of the external water supply is a function of climatic conditions, load of the tower, etc . . . , but in some instances it can be as much as 30° F higher than the external water supply. This difference in temperature could have a significant ecological impact.

SUMMARY OF THE INVENTION

Accordingly, it is a primary object of this invention to provide a means for cooling the blowdown water from an evaporative cooling tower to a temperature within a few degrees of the external water source utilized by the cooling tower.

It is another object of this invention to provide a means for cooling the blowdown from the tower without adding any increased heat load to the external water supply.

It is another object of this invention to cool the blowdown water from a cooling tower without adding a significant increase to the heat exchange duty cycle within the cooling tower.

These and other objects, as well as the nature, scope, and mode of operation of the invention, will become more clearly apparent from the following description, particularly when read in conjunction with the accompanying drawings.

DESCRIPTION OF THE PREFERRED EMBODIMENT

Figure 1:
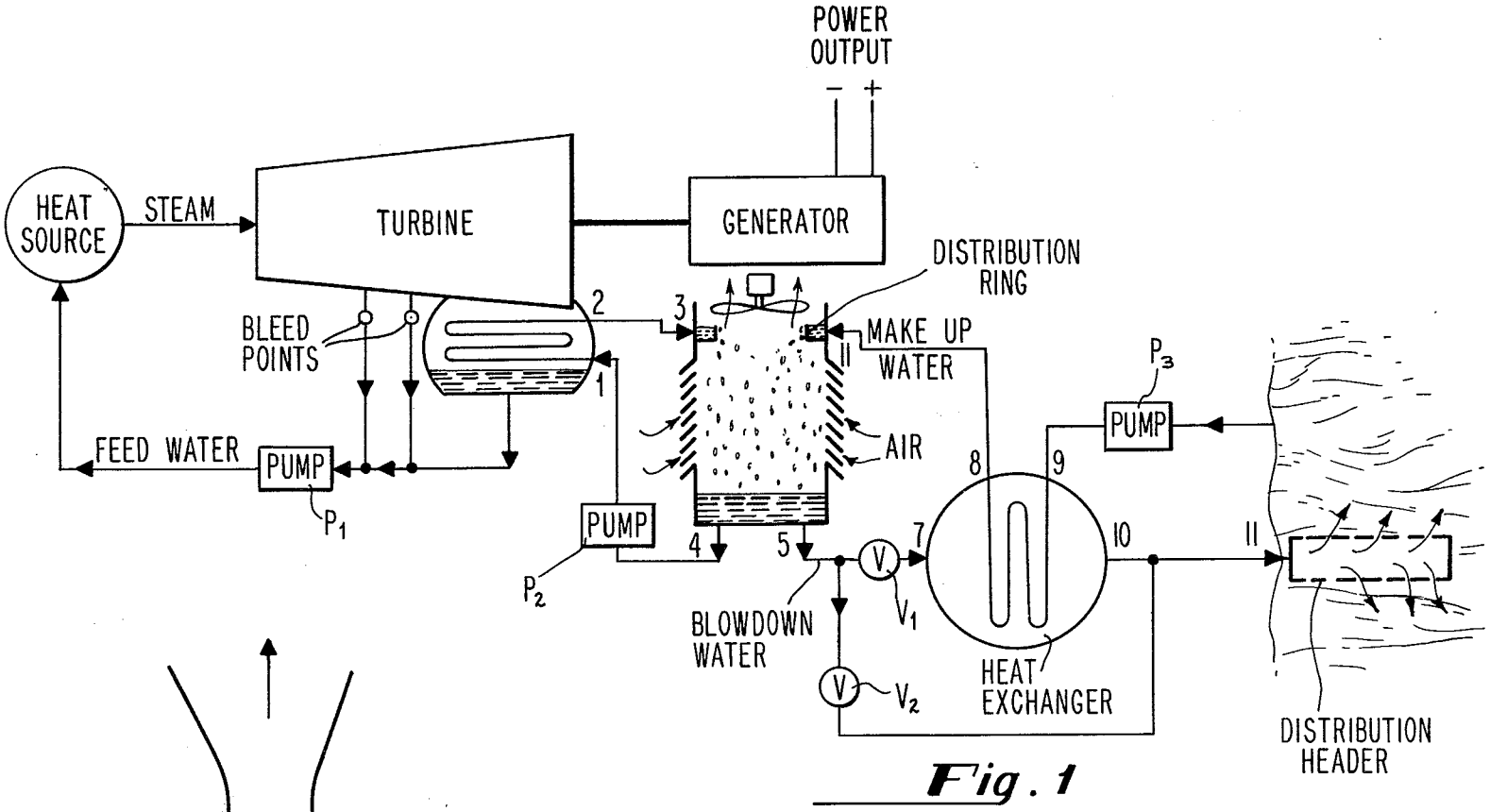
FIG. 1 is a schematic diagram of a steam-driven turbine used in conjunction with an electrical power generator. A mechanical-draft cooling tower cools the condenser water associated with the turbine. A heat exchanger cools the blowdown water from the cooling tower.

A schematic illustration of the steam turbine electrical power generation system is shown in FIG. 1. A heat source is used to convert water into steam which then passes through a turbine providing the motive power to the generator. Some of the steam cools as it goes through the turbine and is bled off at various points and recycled as shown. A large portion of the steam passes through the turbine and is exhausted into a condenser as shown. This steam is condensed into water by the condenser and collects in the hot well of the condenser as illustrated. A pump is used to remove this water from the hot well and feed it back to the heat source for recycling.

The system just described is a closed cycle system. External water flows through the condenser entering at point 1 and exiting at point 2 as shown. The temperature of the inlet steam to the condenser and of the condensate contained in the hot well of the condenser is the same. In an operational configuration this temperature typically ranges between 78° F to 85° F. The difference in energy between the inlet steam and the hot well condensate is the latent heat of vaporization which is removed by the cooling liquid entering at point 1 and exiting at point 2. Cooling water is injected into a cooling tower at point 3 as illustrated.

The function of the cooling tower is to extract the heat load picked up by the cooling water in the condenser. Cooling water enters the cooling tower in a circular distribution header at the top of the tower and then passes through a mesh and enters the shaft of the cooling tower as small water droplets. These water droplets rain through the tower.

The water droplets which have rained down through the tower and been cooled by evaporative loss collect as a liquid at the base of the cooling tower and are extracted at point 4 by a pump which recycles the water through the condenser.

The system just described is open-cycle and three losses occur during operation of the cooling tower. The first is the evaporative loss to the atmosphere which is necessary to achieve cooling. The second loss is termed "drift" water loss, which consists of water droplets that become entrained in the upward draft and are lost to the atmosphere.

The continual addition of makeup water to the cooling tower would result in the accumulation of scale and salts within the circulating water system because loss through evaporation is essentially distilled water leaving the salts behind. To avoid this undesirable buildup of scale and salts, a portion of the water is extracted. This portion, termed "blowdown water, " constitutes the third loss source since it is discharged to the external source of water supply.

The makeup water is thus equal in volume to the volume of water lost through evaporation and drift and the amount of water extracted as blowdown. The extraction of blowdown water is usually operationally so designed that the accumulation of salts within the tower is held to an acceptable level. This accumulation varies, dependent upon system design. Representative operational numbers would be 200 parts per million of total salts contained in the makeup water compared to six hundred parts per million of salts contained in the water collected within the tower. Typically, the salts are constituted of calcium and magnesium sulfates.

Figure 2:
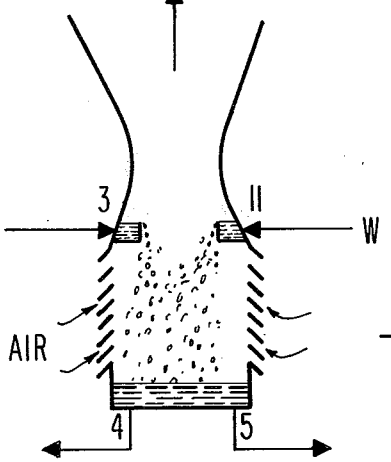
FIG. 2 schematically illustrates a natural draft water cooling tower.

A mechanical-draft tower is illustrated in FIG. 1. A fan is used to create the draft of air through the tower. FIG. 2 illustrates an alternative configuration of a cooling tower termed a natural-draft tower.

A natural-draft tower is considerably taller than an equivalent mechanical-draft tower. The mechanical-draft tower illustrated in FIG. 1 in an operational configuration might be 100–125 feet tall, where an equivalent capacity natural-draft tower would be 500–600 feet tall. The height of the natural-draft tower is required to obtain a differential in temperature between the air entering the bottom of the tower and exiting the top. If the tower is 500 feet high, the differential in temperature between the bottom and the top of the ambient air surrounding the tower is about two to three degrees. The addition of hot water to the natural draft tower will cause a further increase in temperature of the air entering the bottom of the tower and will further increase the tendency of the air to rise. The heat exchanger system which is the novel feature of this invention, could be used with either a mechanical or natural draft air-cooling tower.

Typically, the evaporative loss of an air-cooling tower represents about 3 percent per any unit time of the system water circulating within the tower. Again, by matter of illustration, the blowdown is usually a third to a half of the evaporative loss.

The wet bulb temperature of the air outside the tower governs the amount of cooling that can be effected by the tower. It is not possible to effect cooling below the wet bulb temperature of the ambient air surrounding the tower. For example, assume that the wet bulb temperature of ambient air surrounding the tower is 80 and the temperature of the external water source is 70. The temperature of the blowdown water exiting the tower under these conditions would be 80. If the temperature of this blowdown water were not decreased by passing it through the heat exchanger as illustrated, it could cause an ecological problem when exhausted in the external water supply since a differential temperature of 10 is involved. Depending upon the climatic conditions, this differential can be as high as 30.

The purpose of the heat exchanger illustrated in FIG. 1 is to cool the blowdown water by passing it through a counterflow heat exchanger such that the exit temperature of the water leaving the heat exchanger 10 is approximately the same as the inlet water to the heat exchanger from the external water supply 9. Accordingly, the blowdown water when ultimately injected into the external water supply is at approximately the same temperature and represents no added heat load to the external water supply. The makeup water which flows through the heat exchanger to cool the blowdown water is, of course, heated in the process. This makeup water is, however, applied to the top of the cooling tower 11 and is cooled in the normal operation of the tower.

Representative figures are shown below, for a typical operational installation. It should be noted that the amount of increase in duty cycle of the cooling tower required to cool the makeup water is relatively modest compared to the overall capacity of the tower.

| | |
|---|---|
| Unit Size | $10^9$ watts |
| Circulating Water System Flow Rate | 476,600 gpm |
| Cooling Duty of Tower | $7.9 \times 10^9$ btu/hr entering the tower |
| Tower Blowdown | 4500 gpm |
| Drift | 950 gpm |
| Evaporative loss | 12,650 gpm |
| Makeup water | 18,100 gpm |

| Typical Operating Temperatures | |
|---|---|
| Blowdown temperature | 88.9° F |
| Wet bulb air temperature | 75.0° F |
| River water temperature | 75.0° F |
| Differential temperature | 13.9° F |

Using maximum makeup water yields minimum temperature rise to makeup water to tower per pound of water.

$$\frac{4500}{18{,}100} \times (13.9) = 3.5 \text{ degrees of rise in makeup water temperature}$$

The increased duty to tower resulting from the required cooling of the blowdown water $$18{,}100 \text{ gpm} \times 60 \text{ min/hr} \times 8.3 \text{ lb/gal} \times 3.5 = 2.05 \times 10^6 \text{ btu/hr}$$

$$\text{Percentage increase in tower duty} = \frac{2.05 \times 10^6}{7.9 \times 10^9}(100) = .026\%$$

$$(3.5° \text{ F} = 3.5 \text{ btu/lb})$$

For the example worked out above, it should be noted that the increase in tower duty is considerably less than 0.1% even though the temperature of the blowdown water is 13.9° higher than the river water temperature. Of course, the figures given above are by way of example only and could vary substantially depending upon the climatic conditions.

In some circumstances, it may not be necessary, or even desirable, to cool the blowdown water before discharging it into the external water source. As shown schematically in FIG. 1, valves V1 and V2 can be adjusted to direct any desired amount of the blowdown water through the heat exchanger before exhausting it through a distribution header into the external water source. With V1 closed and V2 open the heat exchanger will by bypassed entirely. With V2 closed and V1 open, all blowdown water will pass through the heat exchanger. Valves V1 and V2 can, of course, be adjusted to intermediate positions to divert only a portion of the blowdown water through the heat exchanger. The blowdown water exhausted into the external water source normally will proceed under the force of gravity, so no pump is necessary on the outlet side of the heat exchanger. The purpose of the distribution header is to distribute the blowdown water evenly into the external water supply so that no localized hot spots or concentrations of salt result. Since, as has been described, this invention contemplates cooling the blowdown to a temperature very close to that of the external water supply, some applications may not require a distribution header. This is desirable, because the cost of such a distribution header can be substantial. It should be noted that the use of a distribution header, while distributing the heat load evenly into the external water supply, does not prevent the addition of the unwanted heat load to the external water supply. It merely represents a dilution of the concentration of hot spots in the external water supply. The use of the heat exchanger, however, does result in a substantial difference in overall system performance in that the unwanted heat load is transferred to the atmosphere rather than to the external heat supply. This is important, because it is becoming an axiom of the ecologists that "dilution is not a solution to pollution."

While the invention has been described above in connection with the generation of electrical power by a steam turbine, it should be understood that it is applicable to any situation where a cooling tower is used to dissipate a heat load into the atmosphere.

The subject matter of the invention is particularly pointed out in the appended claims.

What is claimed is:

1. A method of cooling the exhaust steam from a steam turbine comprising the steps of:

a. passing the exhaust steam through a condenser;
b. passing a stream of cooling water through the condenser;
c. cooling the condenser cooling water by passing it through a cooling tower;
d. extracting blowdown water from the cooling tower to avoid a buildup of salts in the cooling water;
e. adding makeup water from an external source to the cooling tower to compensate for evaporative and drift losses in the tower and the extraction of blowdown water;
f. passing the blowdown water and the makeup water through a heat exchanger which cools the blowdown water to within a few degrees of the temperature of the makeup water;
g. discharging the blowdown water into the external source of makeup water.

2. The method according to claim 1 wherein the makeup water is injected into the top of the cooling tower in Step (e), whereby the makeup water is cooled by the cooling tower.

3. The method according to claim 1 comprising the additional step of passing the blowdown water of Step (g) through a distribution header before discharging the blowdown water into the external source of makeup water whereby the blowdown water is distributed finely into the source of secondary water to disperse the heat load and salt content of the blowdown water evenly into the external water source.

4. An apparatus for cooling the exhaust steam from a steam turbine comprising:

a. a condenser into which the exhaust steam from the turbine is injected wherein said steam is cooled and condensed into water;
b. internal cooling surfaces within the condenser through which a cooling water is circulated;
c. a cooling tower operatively connected to the condenser to cool the cooling water circulated through the condenser;
d. extractor means to withdraw blowdown water from the cooling tower;
e. injector means to insert makeup water from an external source into the cooling tower;
f. a heat exchanger comprising two separate liquid flow channels disposed in close relation to each other to facilitate heat exchange from the blowdown water to the makeup water, operatively connecting the injector and the extractor means and the external source of water as follows:
   1. A first heat exchanger input connected to the extraction means through which blowdown water from the cooling tower is channeled;
   2. A first heat exchanger output for discharging the blowdown water after it has been cooled in the heat exchanger into the external source of water;
   3. A second heat exchanger input operatively connected to the external source of water, through which makeup water is channeled to the heat exchanger;
   4. A second heat exchanger output operatively connected to the injector means, for discharging the makeup water into the cooling tower.

5. The apparatus of claim 4, wherein the heat exchanger is of the counterflow type.

6. The apparatus according to claim 4, wherein bypass means are provided to allow the blowdown water to go directly from the extraction means to the external source of water supply.

7. The apparatus of claim 4, whereby valving means allow for the diversion of varying amounts of blowdown water around the heat exchanger, in such a manner that a variable portion of the blowdown water is channeled through the heat exchanger with the remaining blowdown water bypassing the heat exchanger.

8. The apparatus according to claim 4, whereby the injector means is located at the top of the cooling tower whereby the makeup water is cooled by the cooling tower.

9. The apparatus according to claim 4, wherein the cooling tower is of the mechanical-draft type.

10. The apparatus according to claim 4, wherein the cooling tower is of the natural-draft type.

* * * * *